United States Patent [19]

Boudet et al.

[11] 4,079,914

[45] Mar. 21, 1978

[54] DEVICE FOR GRIPPING A PIN OR BOLT

[75] Inventors: Georges Boudet, St.-Cyr-sur-Loire; Alain Neron; Alain Jacquot, both of Tours, all of France

[73] Assignee: SKF Compagnie d'Applications Mecaniques, Clamart, France

[21] Appl. No.: 737,582

[22] Filed: Nov. 1, 1976

[30] Foreign Application Priority Data

Nov. 6, 1975 France ..... 75 33997

[51] Int. Cl.[2] ..... B25B 21/02

[52] U.S. Cl. ..... 254/1; 254/29 A

[58] Field of Search ..... 254/29 A; 81/126; 294/86 R

[56] References Cited

U.S. PATENT DOCUMENTS

| | | | |
|---|---|---|---|
| 1,385,506 | 7/1921 | Taylor | 81/126 |
| 3,494,592 | 2/1970 | Meschonat et al. | 254/29 A |
| 3,988,952 | 11/1976 | Dirks | 81/126 |

*Primary Examiner*—Robert C. Watson

*Attorney, Agent, or Firm*—Brisebois & Kruger

[57] ABSTRACT

Device having movable jaws for gripping the shank of a pin or bolt is provided with ridges or grooves on the jaws which mate with corresponding ridges or grooves on the shank. The jaws are mounted to slide toward and away from each other and this sliding movement is induced by linkage pivotally connected to the jaws. An abutment is provided for limiting the movement of one of the jaws so that actuation of the linkage causes movement of said one jaw until it strikes the abutment followed by movement of the other jaw.

8 Claims, 6 Drawing Figures

DEVICE FOR GRIPPING A PIN OR BOLT

SUMMARY OF THE INVENTION

This invention relates to a device for gripping the shank of a pin or bolt, especially during operations in which said pin or bolt is being subjected to prestressing.

In hydraulic devices for exerting traction on pins or bolts in order to prestress them and permit a nut to be screwed on to them in this position it is necessary to exert traction on the shank of the pin or bolt, the end of which generally comprises for this purpose a specific structure which cooperates with a traction member. Various means may be used to act on this traction member, for example hydraulic jacks, which bear on a stationary member so that the pin or bolt is placed under tension. In this position it is then easy to manually or automatically screw on a nut without exerting any great force.

It has already been suggested that threads be provided at the end of the shank of the pin or bolt, onto which it is then possible to screw a tapped traction member against which the piston of a hydraulic stretching device may act.

Such a structure has the disadvantage of requiring the traction member to be screwed in place and this is a relatively slow and tedious operation. When a large number of pins or bolts must be simultaneously or successively placed under tension it will be appreciated that the time required to screw the traction members on constitutes a substantial disadvantage of the system.

This disadvantage is particularly great when the pins are in a dangerous atmosphere, for example when the pins serve to hold down the cover of a nuclear reactor vessel. In such a case it is necessary to reduce as much as possible the time required to carry out the different operations in a contaminated atmosphere.

It has therefore been suggested that the traction member be simplified by providing at the end of the shank of the pin or bolt a series of annular ridges which may cooperate with corresponding internal grooves formed in at least two movable gripping jaws which are adapted to grip this part of the shank of the pin and permit the exertion of traction thereon.

The known devices of this type have, however, a certain number of disadvantages. In certain cases (e.g. British Patent No. 884,923) the structure of the means for displacing the movable jaws is such that it prevents any access to the free end of the pin so that it is not possible to screw the pin when the device is in closed position.

Other known devices of this type (e.g. U.S. Pat. No. 3,362,682) which properly release the free end of the pin have means for displacing the jaws which comprise a pneumatic or analogous jack acting independently on each of the jaws. Such a construction is made complex by the multiplication of the number of jacks and the safety obtained is not absolute since one of the jaws may move while the other remains stationary. Moreover, it is difficult to provide for manual actuation of such an assembly because it is necessary to act independently on each of the gripping jaws.

It is the object of the present invention to overcome these disadvantages and the invention relates to a gripping device comprising two translationally movable gripping jaws, the means for displacing these two jaws being of a particularly simple construction and such that the displacement of one jaw necessarily results in a corresponding displacement of the other jaw.

The device according to the invention may be easily operated by hand and, if desired, automatically.

The device for gripping the shank of a pin or bolt provided with annular external ridges according to the invention comprises two gripping jaws provided with annular internal grooves adapted to come into contact with said ridges, said jaws being mounted for radial translational movement with respect to the axis of the pin. In accordance with the invention lateral slides hold the two jaws, the movement of which is controlled by two pairs of lateral rods the rods of each pair being connected to each other by a pivot pin and each rod being pivotally attached to one of the jaws.

The device comprises abutments which limit the opening movement of the jaws so that action on the rods attached to one of the jaws causes successive movement of the two jaws.

The invention will be better understood from the following detailed description of one embodiment thereof, given purely by way of illustration and example, with reference to the accompanying drawings, on which:

Figure 1:
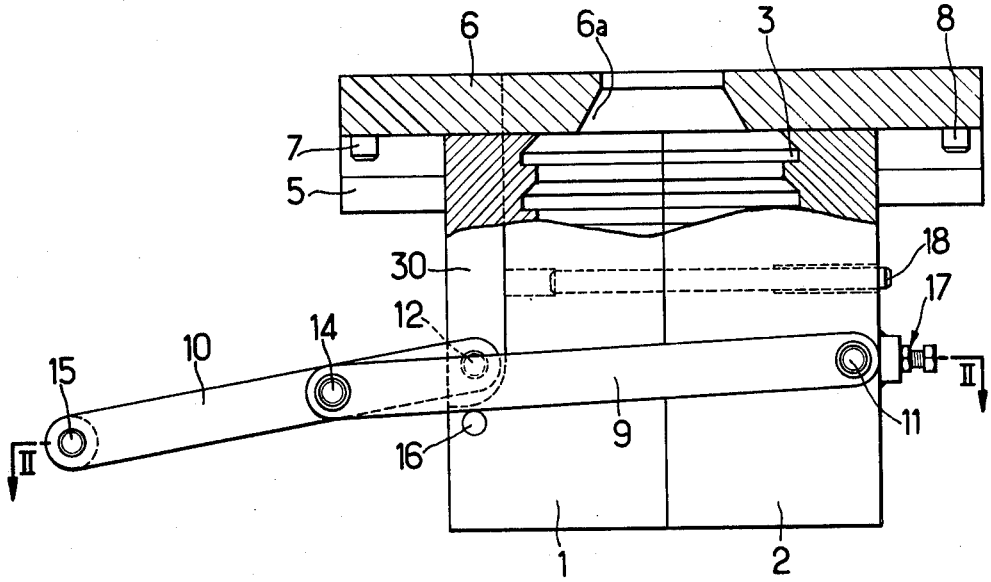
FIG. 1 is a view, partially in section and partially in elevation, of a manually-operated gripping device according to the invention shown in closed position.

As is shown on the figures it will be seen that the manual actuating device comprises two jaws 1 and 2 defining in closed position, that is to say, when side by side, a central cylindrical recess provided with annular internal grooves 3.

The two jaws 1 and 2 have on their lateral surface a guide groove 4 which cooperates with a flange 5 fixed to an upper plate 6 having at its center a hole **6*a*. This hole permits the device to be held in position by cooperating, as may be seen on FIG. 5, with the shank of a pin 20. The jaws 1 and 2 held by these guide grooves 4 which cooperate with the flanges 5 may thus travel in a radial translational movement with respect to the axis of the annular groove 3, this movement being limited, as will be hereinafter seen, by abutments 7 and 8 positioned at the ends of the upper plate 6**.

On each of the lateral sides of the jaws 1 and 2 is a pair of lateral arms 10 and 9. Each inner arm 9 is attached by one of its ends to pivot 11 fixed to the jaw 2. In the same manner the outer bars 10 are attached at one end to a pivot pin 12 attached to the jaw 1. Finally the arms 9 and 10 are connected together by small pivot pins 13 and 14. In this manner the end of each of the arms 9 remote from the pivot pin 11 is connected to one of the pins 13 or 14. The ends of the arms 10 remote from the pivot 12 are connected by a pin 15 which permits, as will be hereinafter seen, the actuation of the device.

Figure 2:
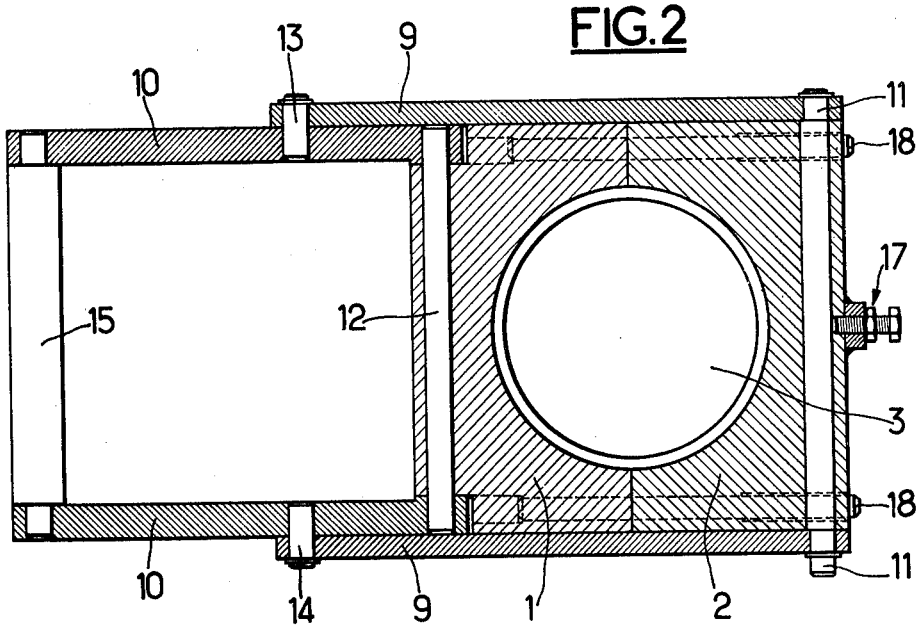
FIG. 2 is a sectional view taken along the line II—II of FIG. 1.
Figure 3:
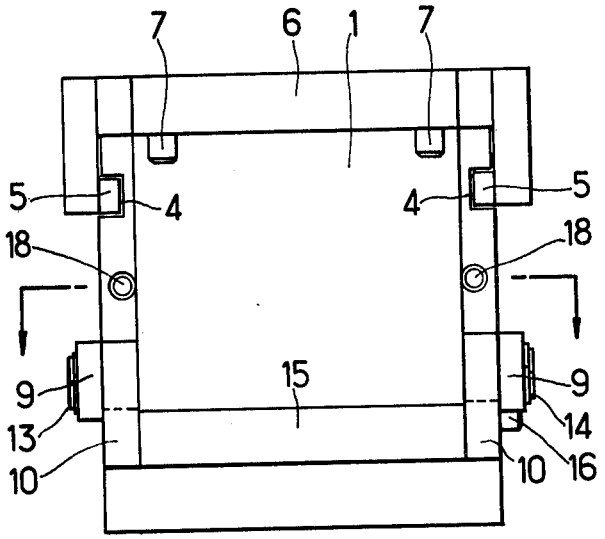
FIG. 3 is a view taken from the left of the device illustrated on FIG. 1.
Figure 4:
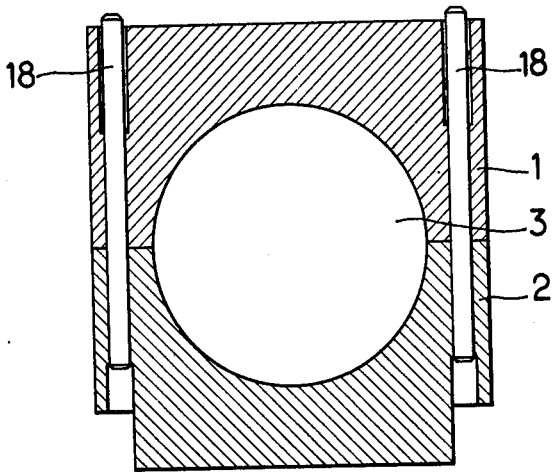
FIG. 4 is a section taken along the line IV—IV of FIG. 3.

As may be seen on FIGS. 1 and 2 the pivot pins 13 and 14 are positioned at a certain distance from the pivot pin 12 in order to define lever arms. Moreover, it will be seen that the arms are so positioned that when they are in closed position as shown in the figures, said arms lie in a substantially horizontal plane, that is to say perpendicular to the axis of the annular grooves 3, the ends of the arms 9 and 10 remote from the stationary ends attached to the jaws 1 and 2, that is to say the left ends of the arms 9 and 10 as seen in FIGS. 1 and 2, both project into one of the lateral sides of the device, in this case the left side. It will be appreciated that it is therefore easy to actuate the device manually by acting only on the pin 15 which is at one side of the device. It will also be understood that it would be easy to position a single jack so as to act on the arms through the pin 15 so as to produce automatic actuation.

It will also be seen that the arms 9, which may be called the inner arms, extend laterally from each side of the two jaws 1 and 2 while the arms 10 which may be called the outer arms are, for the greater part of their length, outside the two jaws, at least when in closed position. Lateral recesses 30 are provided in the jaw 1 and the upper plate 6 in order to permit the passage of the arms in open position.

As may be seen from FIG. 1 the pivot pins 13 and 14 are so positioned on the arms 9 and 10 that, when in closed position, these arms are close to a dead point of the linkage system which corresponds to the horizontal position on FIG. 1. An abutment 16 limits the downward movement of the arm 9. The pivot pin 11 has, as may be seen in FIG. 1, eccentric portions so that the force necessary to overcome the dead point may be adjusted. A lock screw 17 holds the pin 11 in the selected position.

Precision guide pins 18 pass through the jaws parallel to the guide grooves 4 and the flanges 5 to ensure exact positioning of the two jaws relative to each other.

Figure 5:
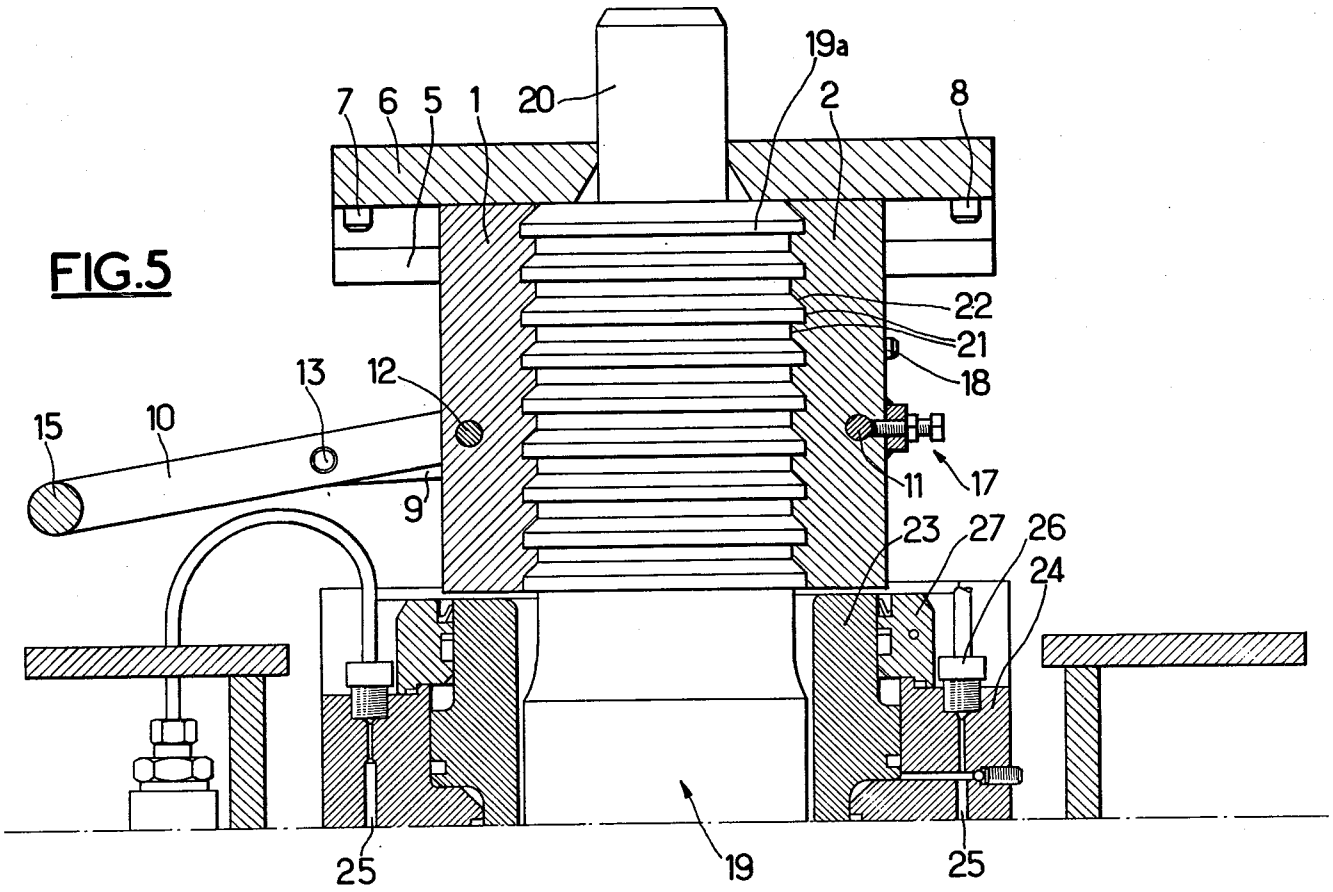
FIG. 5 is a sectional view showing the gripping device of the preceding figures mounted on the upper end of a pin.

FIG. 5 shows the device of the preceding figures mounted on the end of the shank of a pin which is to be prestressed. FIG. 5 shows the jaws 1 and 2 cooperating with annular external ridges **19*a* formed on the end of a pin 19. It will be noted that the upper end 20 of the pin 19 is perfectly open above the device, the upper plate 6 being threaded onto this upper part so that it is easy to automatically screw the pin and the plate 6** is conveniently held in centered position.

The ridges **19*a* as well as the corresponding annular grooves 3 advantageously have a specific profile consisting of a succession of cylindrical portions 21 and conical portions 22 which improve the resistance of the assembly to traction during the prestresing operation. FIG. 5 also shows the presence of a hydraulic piston 23 cooperating with a cylinder 24, the hydraulic fluid being supplied through the duct 25 provided with a pressure relief valve 26, the assembly comprising a sealing cover 27**.

Figure 6:
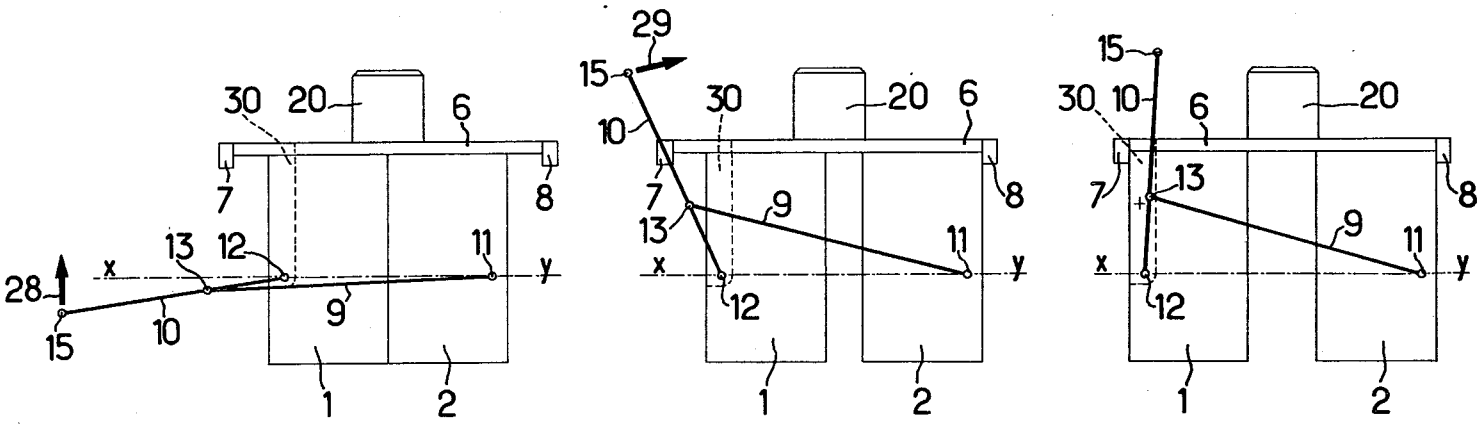
FIG. 6 schematically illustrates the different relative positions occupied by the jaws of a device according to the invention during an opening operation.

FIG. 6 shows the operation of the device according to the invention, for example during the opening operation. (The closing is carried out in an analogous manner by inverting the order of the steps). In the position illustrated on the left of FIG. 6, this device is shown in closed position corresponding to FIG. 1. The arms 9 and 10 have the same position as in FIg. 1 and are located slightly below a horizontal plane indicated by a broken line X,Y, which corresponds to the dead point of the linkage. In order to open the device one acts either manually or by means of a jack or other equivalent means, on the pin 15 located at the end of the arm 10 in the direction of the arrow 28. This action first causes only rotation of the arms 10 about the pin 12 fixed to the jaw 1 which remains stationary. After the passage of the dead point, which increases the grip of the two jaws against each other, the rotating movement of the arm causes rotation of the arm 9 so that the jaw 2 is pushed to the right with respect to the figures so as to come into a corner with the abutment 8 fixed to the plate 6, which is itself held by the pin 20. This position is schematically shown in the middle of FIG. 6. If one continues to rotate the arms 10 in the direction of the arrow 29 of FIG. 6, lateral displacement of the jaw 1 results, which jaw has hitherto been stationary, since the jaw 2 cannot be moved any further and is blocked by the abutment 8. One finally attains the position shown on the right sketch in FIG. 6 which corresponds to the maximum opening of the device according to the invention and in which the jaw 1 has come into contact with the abutment 7. In this position the arms 10 have penetrated into the recesses 30 on the lateral sides of the jaw 1.

As may be seen, the particular structure of the means for displacing the jaws of the device according to the invention makes it possible to considerably simplify the construction and arrange that action on one of the jaws will automatically cause displacement of the assembly. The operation is controlled by one of the pairs of arms and it is possible to easily provide for manual control, as shown on the figures. Of course it will be understood that this manual control means may be replaced by an automatic control means for example, a jack which acts on the ends of the outer arms 10.

What is claimed is:

1. A device for gripping the shank of a pin or bolt comprising, a pair of moveable jaws for gripping said shank; said shank and jaws being formed with mating, interfitting, ridges and groves, a plate having a central hole to receive a portion of said shank to center the gripping device on the pin, lateral slide means mounting said two jaws on said plate for self centering sliding movement toward each other to a gripping position on the pin, and for sliding movement away from each other to an open position with respect to the pin, first and second abutment means positioned respectively at the outer ends of said laterial slide means for engagement by said jaws to limit the extent of movement of the jaws along the plate and to maintain the jaws generally centered with respect to the pin, in an open position of the jaws; two pairs of pivotal arms for controlling the movement of said jaws on said slide means, the arms of each pair being connected to each other by a pivot pin, and one end of each pair of arms being pivotally attached to one of said jaws; so that a force on one pair of arms pivoted to one of the jaws causes a radial translational movement of said one jaw into engagement with one of the abutment means while the other jaw remains stationary and a further force on said one pair of arms causes a radial translational movement of said other jaw into engagement with the other of said abutments.

2. Device as claimed in claim 1 in which the arms are so positioned that, when in closed position, they are in a plane substantially perpendicular to the axis of the pin or bolt, with the ends of the arms remote from the ends fixed to the jaws projecting into a recess in one of the lateral sides of the device.

3. Device as claimed in claim 1 in which the pivot pins connecting the arms of each pair are so positioned that the closed position of the apparatus is near the dead point of a linkage system formed by said arms.

4. Device according to claim 3 in which pivot means attaching at least one pair of arms to the jaws cooperate with displacement means to permit the adjustment of the force necessary to overcome said dead point.

5. Device as claimed in claim 2 in which a pair of internal arms extends laterally from each side of the two jaws while a pair of external arms rests for the greater part of its length outside the jaws.

6. Device as claimed in claim 5 in which the two external arms are connected at their free end by a pin permitting actuation of the device.

7. Device according to claim 1 comprising precision guide pins traversing the jaws parallel to the lateral slides.

8. Device as claimed in claim 1 which comprises a single jack connected to those arms fixed to one of the jaws.

* * * * *